US005899282A

United States Patent [19]

Brussmann

[11] Patent Number: 5,899,282

[45] Date of Patent: May 4, 1999

[54] DEEP-DRILLING APPARATUS WITH HYDROSTATIC COUPLING

[76] Inventor: Dietmar Brussmann, An der Diana 3, D-48455 Bad Bentheim, Germany

[21] Appl. No.: 08/902,468

[22] Filed: Jul. 29, 1997

Related U.S. Application Data

[63] Continuation-in-part of application No. 08/598,330, Feb. 8, 1996, abandoned, which is a continuation of application No. 08/308,796, Sep. 19, 1994, abandoned, which is a continuation-in-part of application No. 08/206,203, Mar. 2, 1994, abandoned, which is a continuation of application No. 07/805,511, Dec. 10, 1991, abandoned.

[51] Int. Cl.[6] ..... E21B 17/07

[52] U.S. Cl. ..... 175/321; 175/325.2

[58] Field of Search ..... 175/228, 297, 175/321, 325.2, 325.4, 347; 285/347

[56] References Cited

U.S. PATENT DOCUMENTS

| | | | |
|---|---|---|---|
| 4,081,043 | 3/1978 | Juergens | 175/297 |
| 4,281,726 | 8/1981 | Garrett | 175/321 |
| 4,336,943 | 6/1982 | Chaplin | 277/26 |
| 4,790,572 | 12/1988 | Slyker | 285/140 |
| 4,792,000 | 12/1988 | Perkin et al. | 175/228 |
| 5,263,682 | 11/1993 | Covert et al. | 251/214 |

OTHER PUBLICATIONS

Carl Gatlin, "Petroleum Engineering", Prentice–Hall Inc., 1960. pp. 52,53,60 and 142–165.

Bourgoyne Jr., et al. "Applied Drilling Engineering", SPE, 1986. pp. 122–126.

"Enzyklopadie Naturwissenschaft and Tecknik", Moderne Industrie 1980, pp. 1233–1234. Dr.Frieder Schuh.

Gatlin "Petroleum Engineering", Prentice Hall, 1960. pp. 94,95,288 and 289.

*Primary Examiner*—Frank Tsay

*Attorney, Agent, or Firm*—Herbert Dubno; Andrew Wilford

[57] ABSTRACT

A deep-drilling system has a vertical tubular drill string having an upper section and a lower section, a rotatable bit at a lower end of the lower section so that when the string and bit are lowered into the ground longitudinally they form therein a bore. A drill mud is pumped at a working pressure longitudinally through the string to emerge at the lower end of the string and flow upward in the bore around the string. A hydrostatic compensator joint in the string between the sections is centered on an upright axis and has a tubular upper part, a threaded joint rigidly connecting the upper part to a lower end of the upper section, a tubular lower part, and a threaded joint rigidly connecting the lower part to an upper end of the lower part. Each part has surfaces directed radially and axially at generally complementary surfaces of the other part. The axially directed surfaces of the upper part are spaced axially from the respective surfaces of the lower part by at most 5 mm. Inter-engaging formations on the parts rotationally couple same together, and a first seal between the surfaces of the parts prevents the drilling mud inside the string and outside the string apart.

12 Claims, 6 Drawing Sheets

DEEP-DRILLING APPARATUS WITH HYDROSTATIC COUPLING

CROSS REFERENCE TO RELATED APPLICATION

This application is a continuation-in-part of application 08/598,330 filed 8 Feb. 1996, now abandoned, which is a continuation of 08/308,796, filed Sep. 19, 1994, now abandoned, which is a continuation-in-part of now abandoned application 08/206,203 filed 2 Mar. 1994 as a file-wrapper-continuation of now abandoned application 07/805,511 filed 10 Dec. 1991 with a claim to the priority of German application P 40 40 155.3 filed 15 Dec. 1990.

FIELD OF THE INVENTION

The present invention relates to a deep-drilling apparatus. More particularly this invention concerns such a hydrostatic coupling or joint for a deep-drilling string.

BACKGROUND OF THE INVENTION

In a standard deep-drilling operation a drill string formed by a plurality of longitudinally interconnected drill rods, e.g. about 10 m long, or a single so-called tubing/pipe carries at its lower end a drill bit and is suspended from its upper end by a pulley block of a derrick. The bit is rotated either by its own motor in the lower end of the drill string or by rotating the entire string as it is lowered from the derrick so that the bit works its way downward. Drilling mud of high specific gravity is pumped from above ground down through the tubular string to emerge at its lower end and then move back upward in the hole around the string, cooling the bit and bringing to the surface the debris cut by the bit.

As the string moves downward, new drill rods are added to its upper end. The connection is made by forming the one end, normally the upper end, of each section with a shallow internally threaded, downwardly tapered, and frustoconical recess and the opposite end with a short downwardly tapered and externally threaded stub. When threaded together the two frustoconical formations lock extremely tightly, often with some plastic deformation to form an extremely solid joint not only capable of transmitting considerable torque, but also forming a very tight leakproof joint.

With deep-drilling operations it is possible to reach depths of 5000 m to 10,000 m. The drilling mud creates in the hole a pressure that increases downward, increasing by 1 bar to 2 bar for every 10 m. This hydrostatic pressure is effective axially, that is vertically and longitudinally of the drill string, on the drill head carrying the drill bit, while at the upper end only atmospheric pressure is bearing on the drill string and in fact the derrick is normally applying some upward tension on the string.

In the context of known measures (*Encyclopedia of Natural Science and Technology*, Modern Industry; Munich 1980; pages 1233–1234) the drill string comprises one unit with respect to the hydrostatic effects which the drilling mud exerts on it. The hydrostatic pressure of the drilling mud acts on the rotary drill bit within the framework of a state of hydrostatic stress, with an axial component with respect to the drill string which at its upper end merely acts in opposition to atmospheric pressure. The radial components of the upwardly decreasing hydrostatic pressure of the drilling mud, which are distributed over the length of the drills string, cancel each other out. In this way the hydrostatic pressure of the drilling mud acts away from the rotary drilling bit with a component of pressure acting on the bottom end of the drill string. This exerts a lifting force on the drills string which opposes the weight of the drill string acting in the axial direction. The lifting force and weight are superimposed and lead to elastic deformations which result from the state of stress.

A so-called neutral zone is located between a lower section of the drill string with a compressive stress which decreases upward and an upper section of the drill string with a tensile stress which decreases downward. It is understood that the conditions and the position of the neutral zone are altered if the drill string rests on the base of the bore hole with a supporting force which is more or less greater according to the conditions imposed on the hook from which the drill string hangs. It is further understood that for a constant supporting force the neutral zone moves upward within the drill string corresponding to the progress of the drilling and thus corresponding to the increasing hydrostatic pressure with respect to the base of the bore hole.

If a drill string or a drill-string section is placed under a compressive stress, its progress in a straight line is a metastable state. As soon as it is acted upon by lateral forces the drill string can buckle. Since the diameter of a bore hole is, as a rule, larger than the outside diameter of the drill pipes, that part of the drill string which extends from the base of the bore hole to the neutral zone is in danger of buckling when drilling takes place. The direction of drilling of the rotary drill bit can depart from the vertical if buckling takes place. Undesirable deviations in the bore hole can then occur. Moreover due to buckling there is an increased danger of the drill rods breaking in the region of compressive stress.

Within the framework of the known measures, The lower end of the drill string is formed with weights which are constructed as drill rods of heavy wall thickness and therefore great mass. There are also heavy rods which are formed in such a way and arranged in such a number that the drill string in the region between the rotary drilling bit and the neutral zone is stronger and therefore has a reduced tendency to buckle under the influence of the above-mentioned hydrostatic compressive stresses and, if applicable, the compressive stresses determined by the supporting force. For a deep bore hole the part of the drill string which consists of heavy rods can be several hundred meters long.

With the known measures for sinking a deep bore hole, deviations are not eliminated but are merely reduced. Moreover, the bore-hole deviations increase with increasing depth of the bore hole. The use of an increasing number of heavy rods as drilling progresses, due to the increasing hydrostatic pressure, leads to an increase in the load on the hook as the depth of the bore hole increases. The cost of manufacturing and assembling a large number of special heavy rods is high.

It is further standard (see *Applied Drilling Engineering* of A. Bourgoyne (Society of Petroleum Engineers; 1986; p. 122f) to provide a weight collar at the lower end of the bit to move down this neutral zone, and in addition to provide a coupling or joint immediately above the drill bit (see U.S. Pat. No. 4,281,726 of Garrett). Such a known coupling is comprised of two relatively sealed hollow or tubular parts that can move relative to each other axially of the drill string. Their relative axial movability is considerable and each of the parts is fixed to a respective section of the drill string. The two parts may be provided with interengaging formations—splines for instance—which rotationally couple them together, although in a bottom-drive system such coupling may not be necessary. During operation the coupling is under compression and there is no hydro-static decoupling.

In the parent applications I describe an improvement on a drilling method wherein a vertical drill string formed by a plurality of longitudinally joined hollow drill rods has a lower end provided with a bit and is simultaneously rotated and lowered into the ground to form therein a bore of a predetermined diameter and drill mud is pumped through the string to emerge at the lower end thereof and then flow upward in the bore around the string. According to this prior invention the lower end of the string is weighted at the bit and an upward force is applied to an upper end of the string to place the entire string between its ends under tension. The string is provided between its ends with at least one outwardly projecting compensator joint that forms in the bore a constriction in turn forming pressurizable regions such that pressure from the drilling mud is upwardly and downwardly effective in the regions on the coupling.

Thus according to my prior invention hydrostatically independent sections of the drill string are formed in each of which the axial force is formed by the difference between the hydrostatic pressure at the top and at the bottom of the sections.

It follows from the definition of the hydrostatically independent drill-string section that the hydrostatically determined axial stress merely results from the difference in hydro-static pressure between the upper and lower ends of the hydro-statically independent drill-string sections. Thus this stress is proportional to the length of the drill-string section. The latter is selected so that a hydrostatically induced risk of buckling does not arise in the drill-string section, even under the possible effect of the supporting force. A hydrostatically independent drill-string section which is hung in the drilling mud and which is acted upon at its upper end and at its lower end by the hydrostatic pressure of the drilling mud in the bore hole has a compressive stress zone, a neutral zone without compressive stress or tensile stress, and a tensile-stress zone. The position of this neutral zone is thus substantially independent of the depth to which the drill-string section is submerged since it is only the difference in hydrostatic pressure between the upper and lower ends which determines the length of the compressive-stress zone. If a second drill-string section is hung from such a submerged drill-string section, the first drill-string section is placed completely under a tensile stress since the second section exerts a tensile force which exceeds the compressive force on the first section resulting from the hydrostatic pressure difference (a prerequisite for this is that the sections have the same dimensions). The same applies if further sections are hung on. A drill string of this type behaves physically like a chain which is hung in a liquid. A zone of compressive stress only exists in the lower region of the lowest section. Each link of the chain forms a separate unit with substantially balanced upward and downward forces.

If a drill string comprising hydrostatically independent sections is fitted at its lower end with a rotating drill bit and is lowered far enough that the rotary drill bit is located at the base of the bore hole, a compressive load is exerted on the rotary drill bit not by the drill string itself but by a weight of constant mass which is supported near the rotary drill bit. On drilling, a compressive load acts on the rotary drill bit which is independent of the hydrostatic pressure at the base of the bore hole. The compressive load on the rotary drill bit is determined by the mass of the weight minus the hydrostatic pressure difference at the lowest drill-string section. In contrast, the hydrostatic pressure difference for known processes is determined by the complete drill string. In order to produce a definite compressive load on the rotary drill bit, only one (or a few) weight is required for the process, the weight of which is less than the total weight of the heavy rods in the known processes. Furthermore the load on the hook is reduced.

In the drilling system due to the support to the weight in the immediate vicinity of the rotary drill bit, the entire drill string located above the support is under a tensile stress and the drill string cannot buckle. As a consequence, bore-hole deviations are substantially prevented and drilling progresses along a straight line in the vertical direction.

According to details of my prior invention there are a plurality of hydrostatic compensator joints in the string forming in the bore constrictions in turn forming pressurizable regions such that pressure from the drilling mud is upwardly and downwardly effective in the regions on the couplings. Each hydrostatic compensator joint comprises an upper part fixed to one of the rods, a lower part fixed to another of the rods immediately beneath the upper part, formations rotationally coupling the parts together, and limiting formations permitting only very limited relative axial movement between the upper and lower parts. The two parts are coaxial axially interfitting sleeves and the hydrostatic compensator joints each further have a seal between the parts preventing leakage from between them. The coupling formations are axially interengaging teeth and the limiting formations only permitting about 5 mm of relative axial movement. Furthermore but not necessarily, a spring is provided that is braced axially between the parts to urge them axially apart.

The weight in accordance with this earlier invention is formed as a tube coaxial with the string and having an inner diameter that is greater than an outside diameter of the string and a lower end that is attached to the string at the bit. The weight is axially decoupled from the string upward of its lower end. The weight can also have an inner diameter that is smaller than an outside diameter of the string.

The parent applications also disclose a system wherein a collar weight is fitted at the lower end of the string at the bit and at least one hydrostatic compensator joint is provided in the string, preferably immediately above the weight. The hydrostatic compensator joint has a tubular upper part connected to the string above the hydrostatic compensator joint, a tubular lower part connected to the string below the hydrostatic compensator joint and longitudinally limitedly shiftable in the upper part, and means including a seal between the parts.

While these systems offer substantial advantages, they still do not fully recreate in the drill string the desired stress-free relationships seen, for instance, in a chain hung in a body of liquid.

OBJECTS OF THE INVENTION

It is therefore an object of the present invention to provide an improved drill string.

Another object is the provision of such an improved drill string which overcomes the above-given disadvantages, that is which largely eliminates the problem of buckling by a redistribution of axial forces.

SUMMARY OF THE INVENTION

A deep-drilling system has according to the invention a vertical tubular drill string having an upper section and a lower section, a rotatable bit at a lower end of the lower section so that when the string and bit are lowered into the ground longitudinally they form therein a bore. A drill mud is pumped at a working pressure longitudinally through the string to emerge at the lower end of the string and flow upward in the bore around the string. A hydrostatic compensator joint in the string between the sections is centered on an upright axis and has a tubular upper part, a threaded joint rigidly connecting the upper part to a lower end of the upper section, a tubular lower part, and a threaded joint rigidly connecting the lower part to an upper end of the lower part. Each part has surfaces directed radially and axially at generally complementary surfaces of the other part. The axially directed surfaces of the upper part are spaced axially from the respective surfaces of the lower part by at most 5 mm. Interengaging formations on the parts rotationally couple same together, and a first seal between the surfaces of the parts prevents the drilling mud inside the string and outside the string apart.

According to the invention the upper part has a collar formed with an axially upwardly directed surface and the lower part has an axially downwardly directed surface directly confronting and axially spaced from the axially downwardly directed surface of the upper part.

The joint in accordance with the invention is substantially free of threaded torque-transmitting joints between the threaded joints. Furthermore the interengaging formations are free of screwthreads.

The system further has according to the invention a second seal spaced from the first seal between the surfaces and creating with the first seal an annular closed chamber between the surfaces. The interengaging formations are exposed in the chamber and a body of a generally incompressible liquid is captured in the chamber between the seals. The body is pressurized via one of the seals from the drill mud. This liquid is an oil-like lubricant and serves not only to lubricate the surfaces it contacts, but also to transmit the pressure to these surfaces while keeping them out of contact with the abrasive particles in the drilling mud. In this arrangement one of the parts can be provided with a movable piston or membrane defining a portion of the chamber and movable in the one part to compensate for increases and decreases in the volume of the chamber.

All the surfaces that transmit tension and pressure according to the invention between the parts are exposed in the chamber. The parts can have surfaces exposed to the pressure of the mud inside the string to separate the parts, that is with the mud getting between them, or conversely to push them together.

The system according to the invention further can have an elastically compressible ring between one of the axially directed surfaces of the upper part and the complementary axially oppositely directed surface of the lower part.

The interengaging formations include interengaging teeth formed on the parts. These teeth mesh radially with one another. Furthermore the seal according to the invention is arranged between the radially directed and confronting surfaces of the parts.

It is critical to the invention that the two parts of the joint be able to move axially relative to each other, up to 5 mm, normally only about 1 mm. In fact even with only 0.1 mm of relative displacability it is possible to achieve the desired decoupling according to this invention. This relative movement is limited by the spacing between the axially confronting surfaces and by the mechanical characteristics, mainly the elasticity, of any elements engaged between them.

The typical compensator joint according to the prior art permits relative movement in the 10 to 50 cm range. This results in a substantial impact when the end of the extension is reached. Such shock absorbers or bumpers are invariably installed immediately above the bit at the lower end of the drill string and incorporates springs for damping vibrations. The shock absorber needs to be able to move axially at least 5 cm. Such a device of the so-called thruster type has an axial displacability of up to 150 cm in order to produce an advancing force powered by the pump pressure.

These known connecting elements are as mentioned always used in the lower end of the drill string, unlike the system of this invention which is used much higher up, in fact in the region where the drill string is axially tensioned, not compressed. The small displacement—at most 5 mm—of the system of this invention allows for much greater stability of the drill string. Furthermore it does not have the screwthread connections of the prior-art systems which are the parts most likely to fail.

One such compensator joint is used in a normal drill string and two or more in a very long one. The placement of the lower joint is such that the section of drill string below it is solely in axial compression while the drill string above it is in tension. This achieves the hydrostatic decoupling characteristic of a chain hung in a body of liquid. According to the invention such a joint is positioned generally at the above-defined neutral zone. Preferably the joint is slightly above, about 50 m, this neutral zone in a 5000 m long drill string, which places the joint about 800 m above the thick-walled lower tube sections. Normally one joint according to the invention is needed in a standard drill string, changing the 25/35 prior-art ratio to a 2/3 one. Thus a substantially shorter lower section is used, with the upper section above the joint as mentioned wholly in axial tension. Only drill strings longer than about 5000 m need more than one such joint according to the invention. Either way the neutral zone is moved downward until it is virtually at the lower-end drill bit.

BRIEF DESCRIPTION OF THE DRAWING

The above and other objects, features, and advantages will become more readily apparent from the following description, reference being made to the accompanying drawing in which.

SPECIFIC DESCRIPTION

Figure 1A:
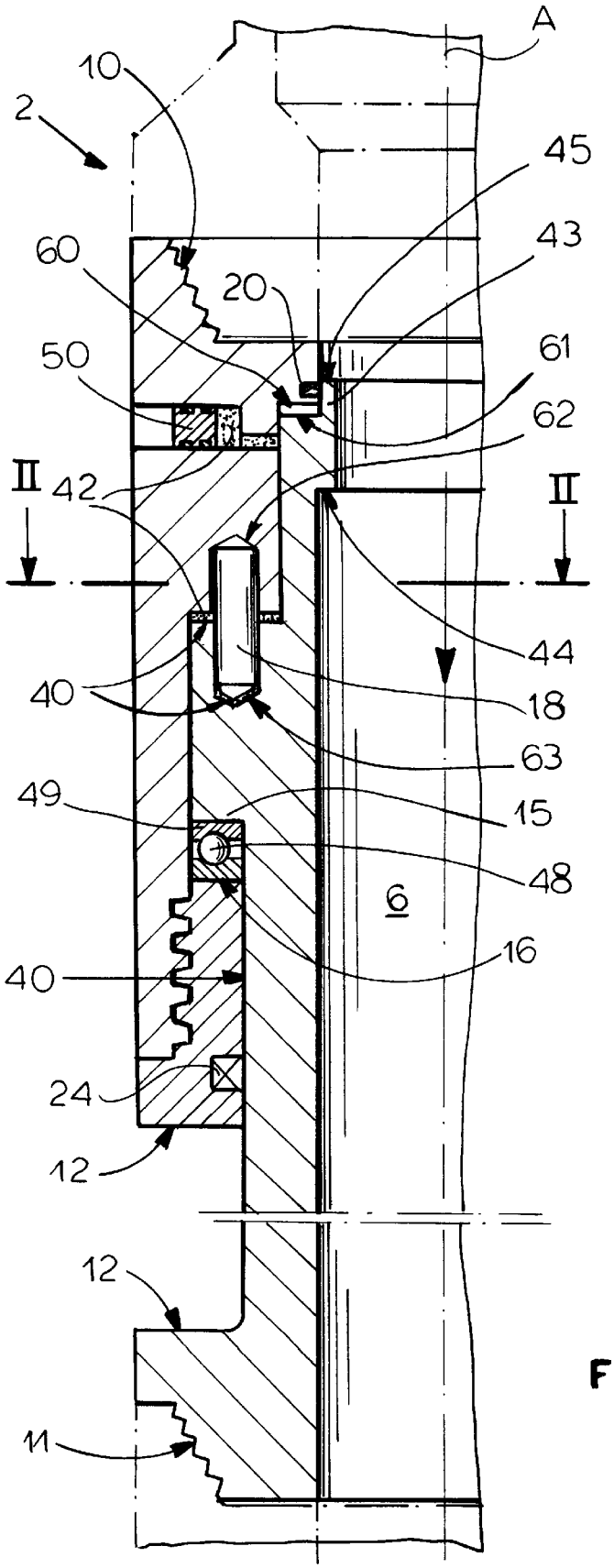
FIGS. 1A and 1B are axial sections through a coupling according to the invention.

As seen in FIGS. 1A through 4B a hydrostatic compensator joint 1 according to the invention is centered on a normally upright axis A and has an upper part 8 formed with a frustoconical internally threaded seat 10 to which is screwed an upper tube section 2 and a lower part 9 formed with a frustoconical externally threaded stub 11 that is threaded into the upper end of a lower tube section. Thus the upper part 8 is effectively integral or unitary with the tube section 2 and the lower part 9 with the tube section 3.

Between the parts 8 and 9 is a radial spacing 40 and an axial spacing 22. The spacing 22 measures axially at most 5 mm so that the parts 8 and 9 can move axially relative to each other at least limitedly. More specifically the parts 8 and 9 have axially confronting surfaces 15 and 16 which can e provide with axially compressible elements as described below to permit the relative displacement of up to 5 mm. Here the surface 16 is formed by a collar secured by a screwthread 41 to the lower end of the upper part 8. This screw connection 41 does not transmit torque; instead it solely secures the part 8 to the collar 37. Instead angular force or torque is transmitted through the joint 1 by formations 18, 26, or 28 on the part 9 and formations 19, 27, or 29 on the part 8.

In the joint 1 shown in FIGS. 1A through 4B the hydrostatic pressure of the drilling mud 6 inside the joint 1 and the drilling mud 14 outside the joint 1 are effective on all the surfaces extending perpendicular to the axis A, that is the axially directed surfaces, of the parts 8 and 9. This can be direct or via a body 42 of an incompressible liquid, here a lubricating grease. In addition the body 8 has a lowermost surface 12 that directly confronts an uppermost surface 13 of the body 9, with the outside mud 14 being axially oppositely effective on these surfaces 12 and 13.

The effect of the liquid pressure on all contact surfaces 12, 13, 15, 16, 44, 45, 46, 47, 60, 61, 62, and 63 that extend transverse to the axis A thus cover virtually the entire cross-sectional area of the bore and are balanced upward and downward. This insures the effective hydrostatic decoupling of the parts 2 and 3 from each other. The assembly will have the same hydrostatic characteristics as a chain of links as described above.

First and second seals 20 and 24 are provided between radially confronting surfaces of the parts 8 and 9. The chamber between these seals 20 and 24 is filled with the body 42 of grease that is pressurized by the inside mud 6 and outside mud 14. This body 42 of lubricant therefore forms a film over most of the transverse contact surfaces between the two parts 8 and 9. The coupling formations 18, 19, 26, 27, 28, and 29 are in this lubricant-filled chamber also. A radially displaceable piston 50 defines a portion of the wall of this chamber and can move in and out to compensate for changes in the volume of this chamber as the parts 8 and 9 move axially relative to each other.

Figure 2A:
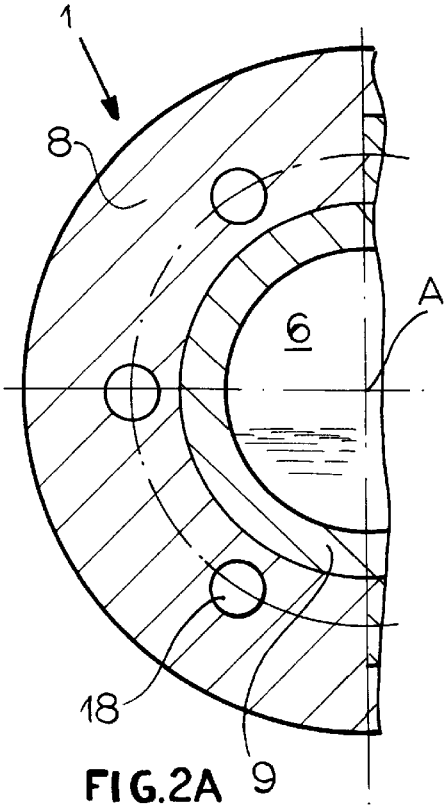
FIGS. 2A and 2B are sections taken along lines II of respective FIGS. 1A and 1B.

The embodiment of FIGS. 1A and 2A has pins 18 lodged in the two parts 8 and o so as to rotationally couple them while still permitting them to move axially relative to each other. In addition a bearing constituted by compressible balls 48 and races 49 can be provided between the surfaces 15 and 16. Finally the part 9 has a radially inwardly projecting ridge 43 forming upper and lower surfaces 44 and 45 exposed to the inside mud 6 for pressure equalization. The pressure of this inside mud is the hydrostatic pressure determined by how deep it is plus that added by the below-described above-ground pump.

Figure 1B:
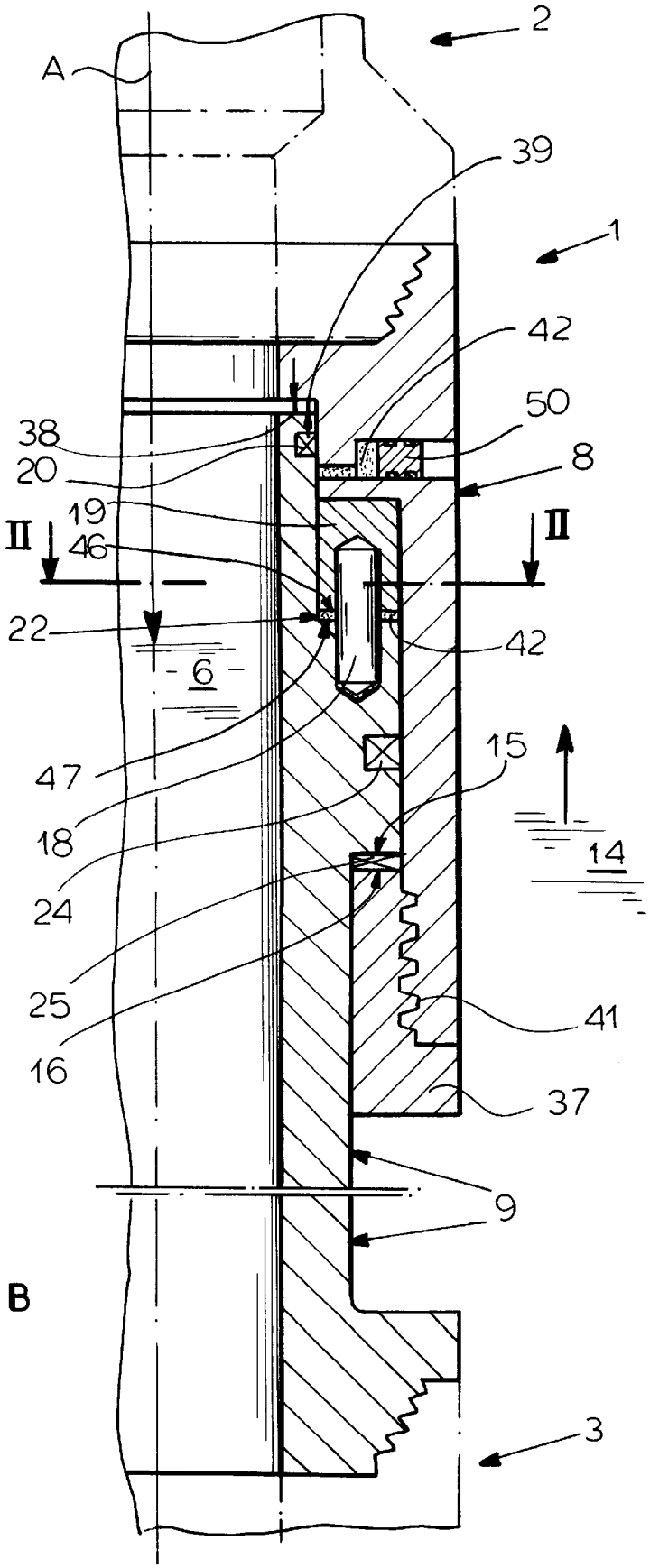
Figure 2B:
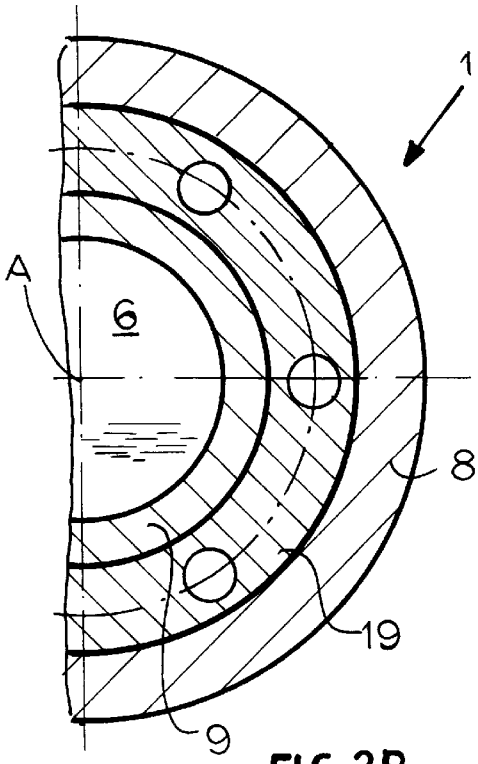

In FIGS. 1B and 2B the pins 18 are seated in a ring 19 that is fixed in the part 8, typically be a shrink fit. The parts 8 and 9 have confronting identical surfaces 39 and 38 that are exposed to the pressure of the inside mud 6. The remaining transverse surfaces are acted on by the outside mud 14. In addition an axially compressible ring 25 is provided between the surfaces 15 and 16.

Figure 4A:
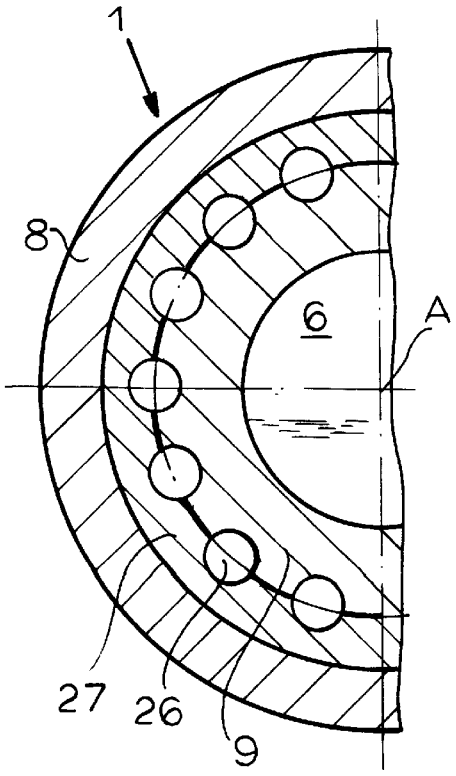
FIGS. 4A and 4B are sections taken along lines IV of respective FIGS. 3A and 3B.
Figure 3A:
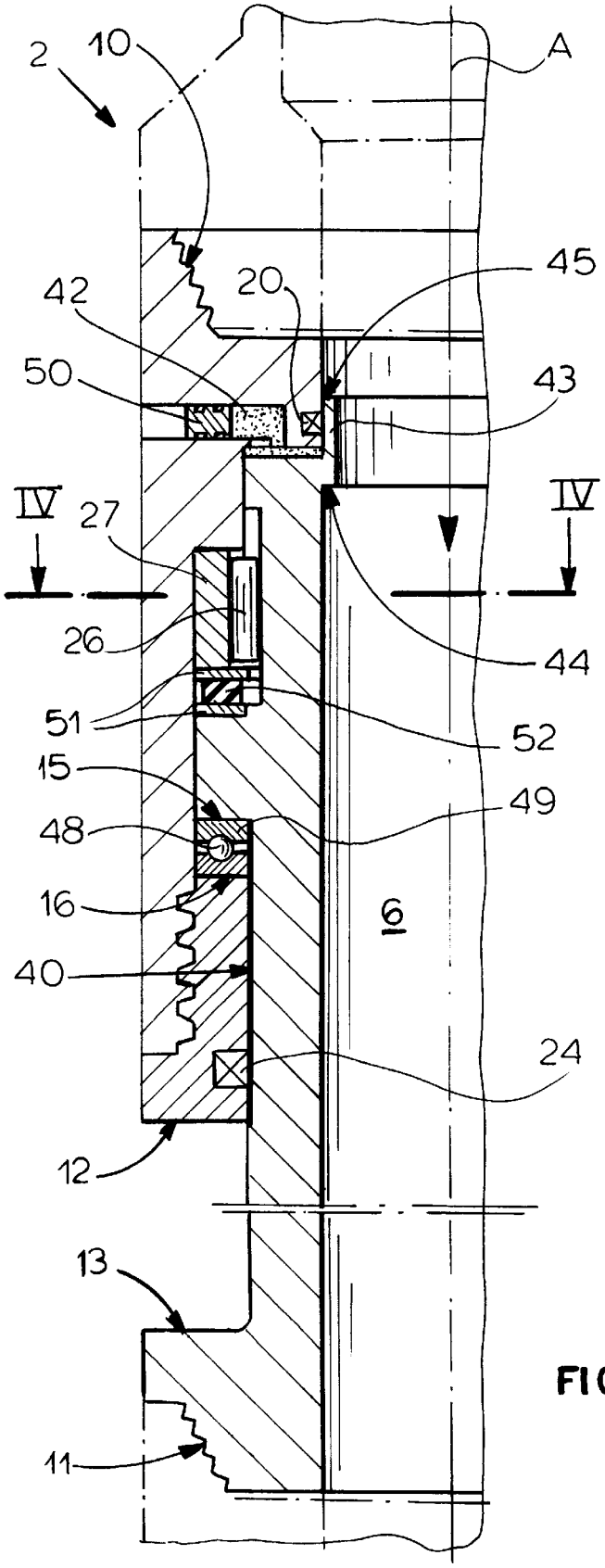
FIGS. 3A and 3B are axial sections through another coupling according to the invention.

The embodiment of FIGS. 3A and 4A has entrainment rods 26 set in outwardly open grooves of the part 9 and inwardly open grooves of a ring 27 fixed like the ring 19 in the part 8. Thus these rods 26 provide for torque coupling without impeding relative axial movement of the parts 8 and 9. Here also steel washers 51 sandwich an elastically compressible ring 52.

Figure 4B:
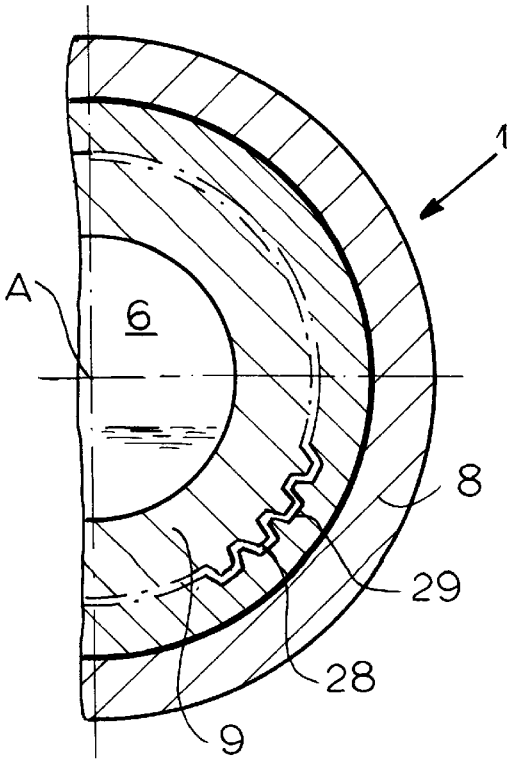
Figure 3B:
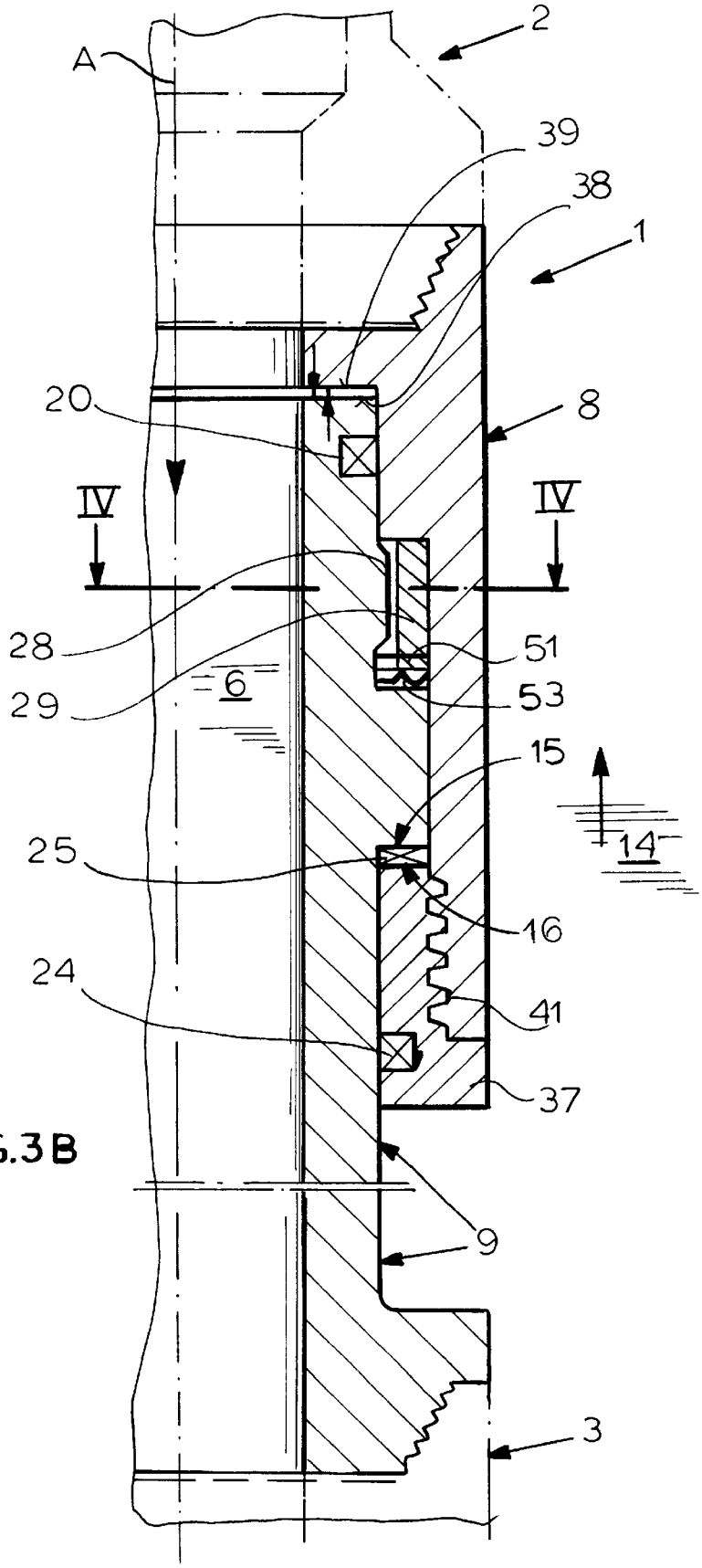

In FIGS. 3B and 4B the formations are teeth 28 formed on the part 9 and on a ring 29 fixed by a shrink fit in the part 8. A wavy metal washer 53 that is axially compressible is engaged between a washer 51 bearing via the ring 29 on the part 8 and a surface of the part 9.

It is to be understood that in all the embodiments shown in FIGS. 1A through 4B the appropriate axial tolerances are provided between the parts 8 and 9, even if in some places elastically compressible elements like the rings 25, 52, and 53 are placed there for the axial minimal axial displacability according to the invention. In this manner the hydrostatic mud pressure is directly or indirectly applied to nearly all the transverse contact surfaces of the parts 8 and 9.

It is important that on securing the collar 37 in place by means of the screwthread 41, the surfaces 15 and 16 or 46 and 47 are not brought into contact with each other. Otherwise the relative axial displacability would be lost. In addition the screwthread 41, which could be replaced by another type of fastening, in no way is used to transmit torque; it solely serves to hold in place the collar 37 against which only axial forces are applied.

Figure 5:
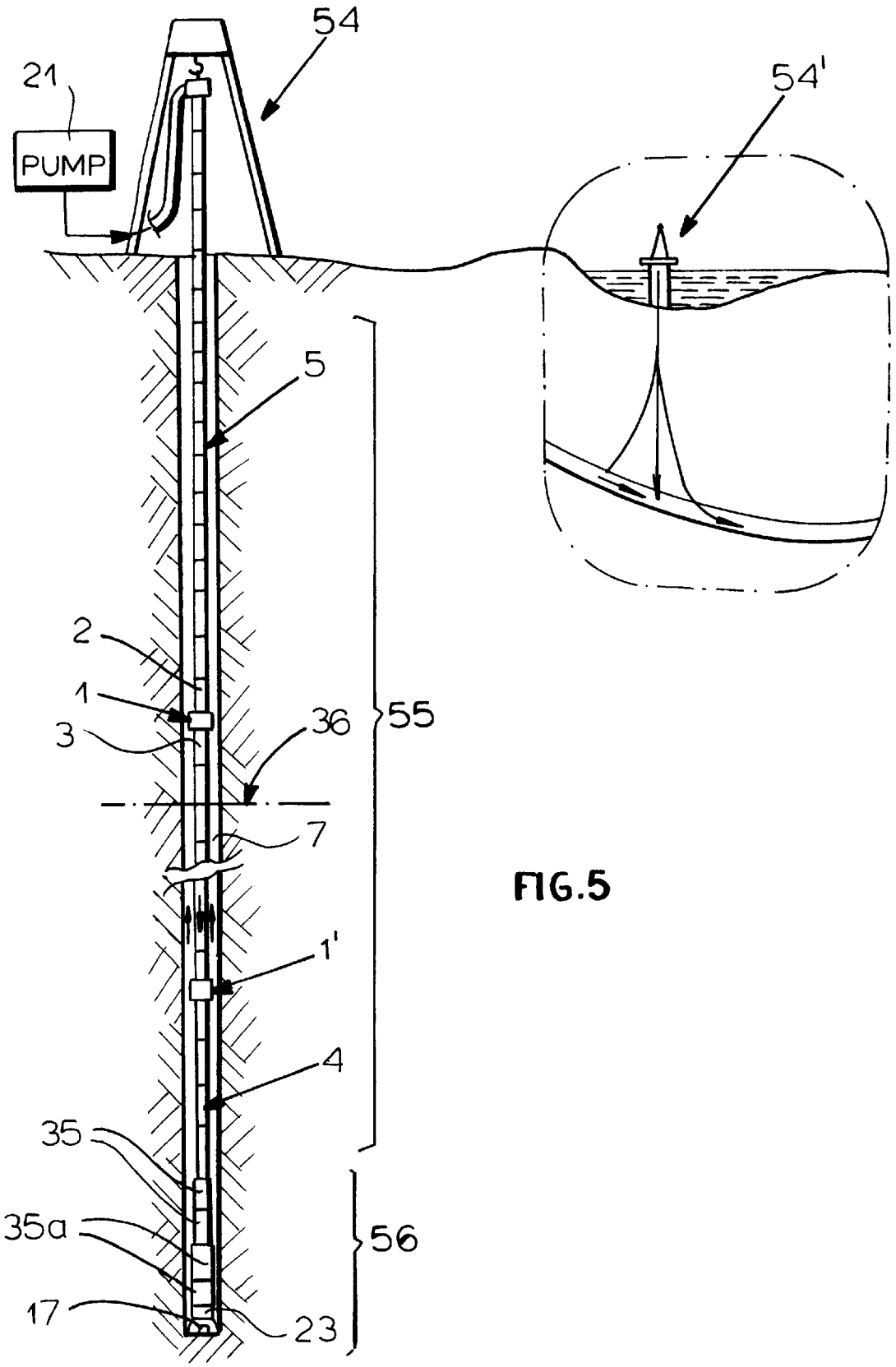
FIG. 5 is a largely diagrammatic sectional view illustrating drill strings according to the invention.

In FIG. 5 a derrick 54 is shown connected to the upper end of a drill string 5 having a long upper portion 55 formed of thin-walled tubes 4 and a short lower portion 55 formed of thick-walled tubes 35 and 35*a*. The lower end carries a motor 23 and a drill bit 17 for forming the bore hole 7. A pump 21 is provided above ground fro forcing drilling mud down through the string 5 and up in the bore 7 around it. Another derrick 54' in an offshore setup for slant drilling is shown to the right.

Here the bore hole 7 is some 5000 m long and the lower region has an air weight of about 30 t, so as to exert a downward force of about 20 t on the bit 17. The string 5 has a neutral zone 36 with one compensator joint 1 provided about 800 m above the lower section 56 and another such joint 1' about 300 m above it. The thin-walled tubes 4 of the upper portion 55 are wholly in tension. Reduced axial compressive forces are only present in the thick-walled lower region 56. Thus there is no significant likelihood of the string 5 buckling.

I claim:

1. A deep-drilling system comprising:

a vertical tubular drill string having an upper section and a lower section;

a bit at a lower end of the lower section;

means for rotating the bit;

means for lowering the string and bit into the ground longitudinally to form therein a bore;

means for pumping drill mud at a working pressure longitudinally through the string to emerge at the lower end of the string and flow upward in the bore around the string; and a hydrostatic compensator joint in the string between the sections, centered on an upright axis, and having a tubular upper part, a threaded joint rigidly connecting the upper part to a lower end of the upper section, a tubular lower part, each part having surfaces directed radially and axially at generally complementary surfaces of the other part, the axially directed surfaces of the upper part being spaced axially from the respective surfaces of the lower part by at most 5 mm, a threaded joint rigidly connecting the lower part to an upper end of the lower part, interengaging formations on the parts rotationally coupling same together, and means including a first seal between the surfaces of the parts for keeping the mud inside the string separate from the mud outside the string.

2. The deep-drilling system defined in claim 1 wherein the upper part has a collar formed with an axially upwardly directed surface and the lower part has an axially downwardly directed surface directly confronting and axially spaced from the axially downwardly directed surface of the upper part.

3. The deep-drilling system defined in claim 1 wherein the joint is substantially free of threaded torque-transmitting joints between the threaded joints.

4. The deep-drilling system defined in claim 1 wherein the interengaging formations are free of screwthreads.

5. The deep-drilling system defined in claim 1 further comprising a second seal spaced from the first seal between the surfaces and creating with the first seal an annular closed chamber between the surfaces, the interengaging formations being exposed in the chamber; and a body of a generally incompressible liquid in the chamber between the seals, the body being pressurized via one of the seals from the drill mud.

6. The deep-drilling system defined in claim 5 wherein the liquid is an oil-like lubricant.

7. The deep-drilling system defined in claim 6 wherein one of the parts is provided with a movable piston defining a portion of the chamber and movable in the one part to compensate for increases and decreases in the volume of the chamber.

8. The deep-drilling system defined in claim 5 wherein all the surfaces that transmit tension and pressure between the parts are exposed in the chamber.

9. The deep-drilling system defined in claim 1, further comprising an elastically compressible ring between one of the axially directed surfaces of the upper part and the complementary axially oppositely directed surface of the lower part.

10. The deep-drilling system defined in claim 1 wherein the interengaging formations included interengaging teeth formed on the parts.

11. The deep-drilling system defined in claim 10 wherein the teeth mesh radially with one another.

12. The deep-drilling system defined in claim 1 wherein the seal is arranged between the radially directed and confronting surfaces of the parts and are adapted to slide on the parts.

* * * * *